US006655028B2

(12) United States Patent
Coffin

(10) Patent No.: US 6,655,028 B2
(45) Date of Patent: Dec. 2, 2003

(54) WET SHAVING DEVICE WITH GUARD/ TRANSFER ROLLER AND REPLACEABLE SHAVING AID

(75) Inventor: David C. Coffin, Milford, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 10/132,823

(22) Filed: Apr. 24, 2002

(65) Prior Publication Data

US 2002/0157255 A1 Oct. 31, 2002

Related U.S. Application Data

(60) Provisional application No. 60/287,101, filed on Apr. 27, 2001.

(51) Int. Cl.[7] ..... B26B 21/44
(52) U.S. Cl. ..... 30/41; 30/83
(58) Field of Search ..... 30/34.05, 41, 50, 30/77, 79, 81, 83, 537, 538

(56) References Cited

U.S. PATENT DOCUMENTS 2,103,402 A * 12/1937 Beckley ..... 30/83
3,768,161 A * 10/1973 Miller ..... 30/41
4,502,217 A * 3/1985 Schachter ..... 30/83
4,562,644 A * 1/1986 Hitchens ..... 30/41
5,134,775 A * 8/1992 Althaus et al. ..... 30/41
5,711,076 A * 1/1998 Yin et al. ..... 30/41
5,903,979 A * 5/1999 Oldroyd ..... 30/41

FOREIGN PATENT DOCUMENTS

EP 1 252 985 A1 10/2002

* cited by examiner

*Primary Examiner*—Hwei-Siu Payer
(74) *Attorney, Agent, or Firm*—McCormick, Paulding & Huber LLP

(57) ABSTRACT

A wet shaving device has a razor head carried by a handle and supports a disposable blade cartridge which has a plurality of blades. A guard/transfer roller supported for rotation on the razor head in advance of a lead blade provides a guard for the lead blade, forms a closure for a dispensing slot in the razor head, receives soap film from a wetted block of soap preparation disposed within the dispensing slot, and transfers soap film from the wetted block to and deposits it ahead of the lead blade and on the skin surface being shaved during a normal shaving process. A spring biased pusher disposed within the dispensing slot and which normally urges the block of soap preparation into engagement with the roller is manually withdrawn from the dispensing slot to facilitate replenishment of spent soap preparation.

20 Claims, 4 Drawing Sheets

WET SHAVING DEVICE WITH GUARD/ TRANSFER ROLLER AND REPLACEABLE SHAVING AID

CROSS-REFERENCE TO RELATED APPLICATIONS

The present application is a U.S. non-provisional application. This application claims the benefit of 60/287,101 filed on Apr. 27, 2001, under 35 USC 119(e)

FIELD OF INVENTION

This invention relates in general to shaving devices and deals more particularly with razors of the wet shaving type which include solid water-soluble shaving aids.

BACKGROUND OF THE INVENTION

It is well known in the shaving art to provide a wet shaving device or razor which includes a solid water-soluble shaving aid or surface active agent, such as a soap preparation, formulated to provide cleansing, lubricating, skin-healing or moisturizing effects or any combination thereof. However, if the solid water-soluble shaving aid directly contacts the skin surface during the shaving process it may be subject to a high rate of wear or erosion from skin contact, hot water and other shaving preparations. The surface of the shaving aid may also be impacted with shaving debris making it unsightly and creating an impression that it is unhygienic.

A means for attachment must be provided to secure such a shaving aid to a razor. Those skilled in the shaving art will appreciate the limited mechanical properties of solid soap and like products which may serve as shaving aids. Where such a product is employed as a shaving aid a substantial portion of the product must be utilized to anchor it to a razor head thereby rendering a substantial percentage of the product unusable.

Accordingly, it is a general aim of the present invention to provide and improved wet shaving device having means for receiving a film of shaving aid preparation from a wetted block of water-soluble shaving aid preparation and transferring the film of shaving aid preparation to and depositing it on the skin immediately forward of a leading cutting edge of the advancing device for cleansing of sebum, lubricating, skin moisturizing or other beneficial effect. It is a further aim of the invention to provide an improved wet shaving device which efficiently utilizes a solid water-soluble shaving aid avoiding waste and allowing for replacement of the spent shaving aid, when necessary.

SUMMARY OF THE INVENTION

In accordance with the present invention, a wet shaving device has a razor head which carries at least one blade and includes a guard/dispenser roller with a generally cylindrical roller surface and supported forward of a leading blade for rotation about an axis relative to the blade. The device further includes mounting means on the razor head for supporting a solid water-soluble shaving aid in dispensing position relative to the roller, retaining means for releasably securing a shaving aid in the mounting means, and biasing means for urging a shaving aid to dispensing position wherein it is in contact with the roller surface. The guard/dispenser roller serves both as a guard for the leading blade and as a means for transferring a film of shaving aid material from a water-soluble shaving aid supported by the mounting means to the skin surface immediately in advance of the leading blade during a normal wet shaving process.

DETAILED DESCRIPTION OF PREFERRED EMBODIMENT

Figure 1:
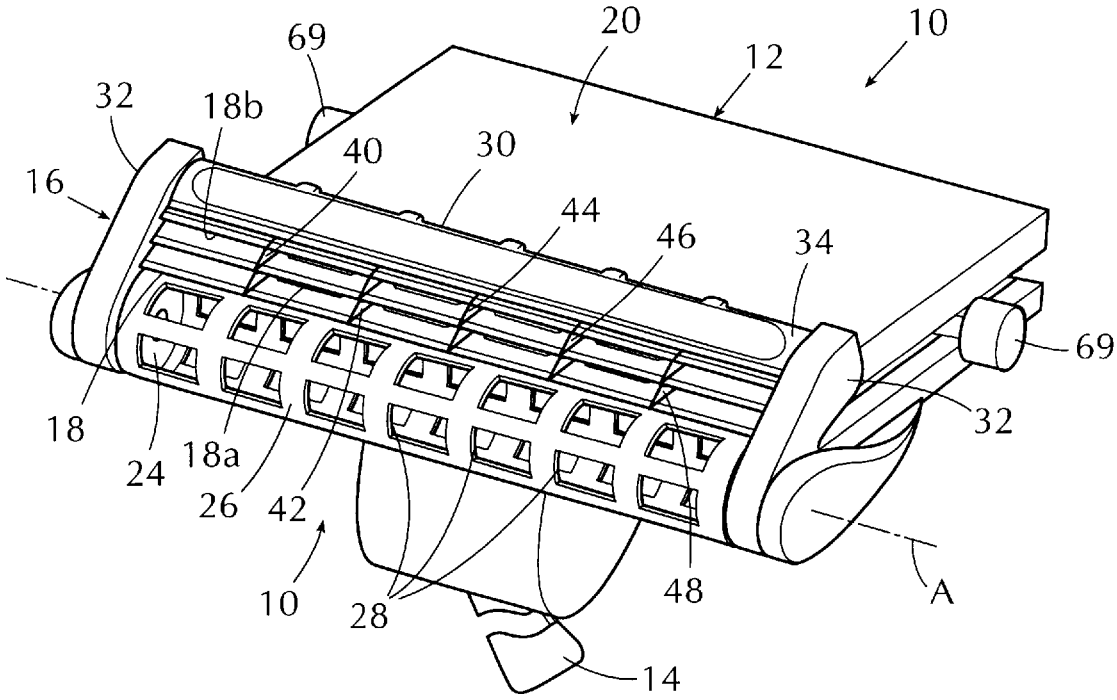
FIG. 1 is an orthographic view of a wet shaving device embodying the present invention.

In the drawings and description which follows, the present invention is illustrated and described with reference to a wet shaving device or razor embodying the invention and indicated generally by the reference numeral 10. The illustrated razor 10, shown in FIGS. 1–5, essentially comprises a razor head designated generally by the reference numeral 12 and carried by a handle 14. A disposable blade cartridge indicated generally at 16 and which comprises a part of the razor head 12 is releasably supported on the razor 10 and carries at least one blade 18 which comprises a lead or seat blade. The razor head 12 further includes a shaving aid dispenser designated generally by the numeral 20 for receiving and containing a replaceable solid water-soluble shaving aid, such as a block of medicated soap preparation indicated by the letter S and best shown in FIG. 4. A guard/transfer roller 22 supported for rotation on the razor head in advance of the lead blade 18 serves as blade guard and also cooperates with the shaving aid dispenser 20 to pick up a thin coating or film of shaving aid material from a shaving aid preparation contained within the shaving aid dispenser and transfer it to and deposit it on the surface of the skin ahead of the advancing blade 18 during a normal shaving operation, all of which will be hereinafter more fully discussed.

Figure 5:
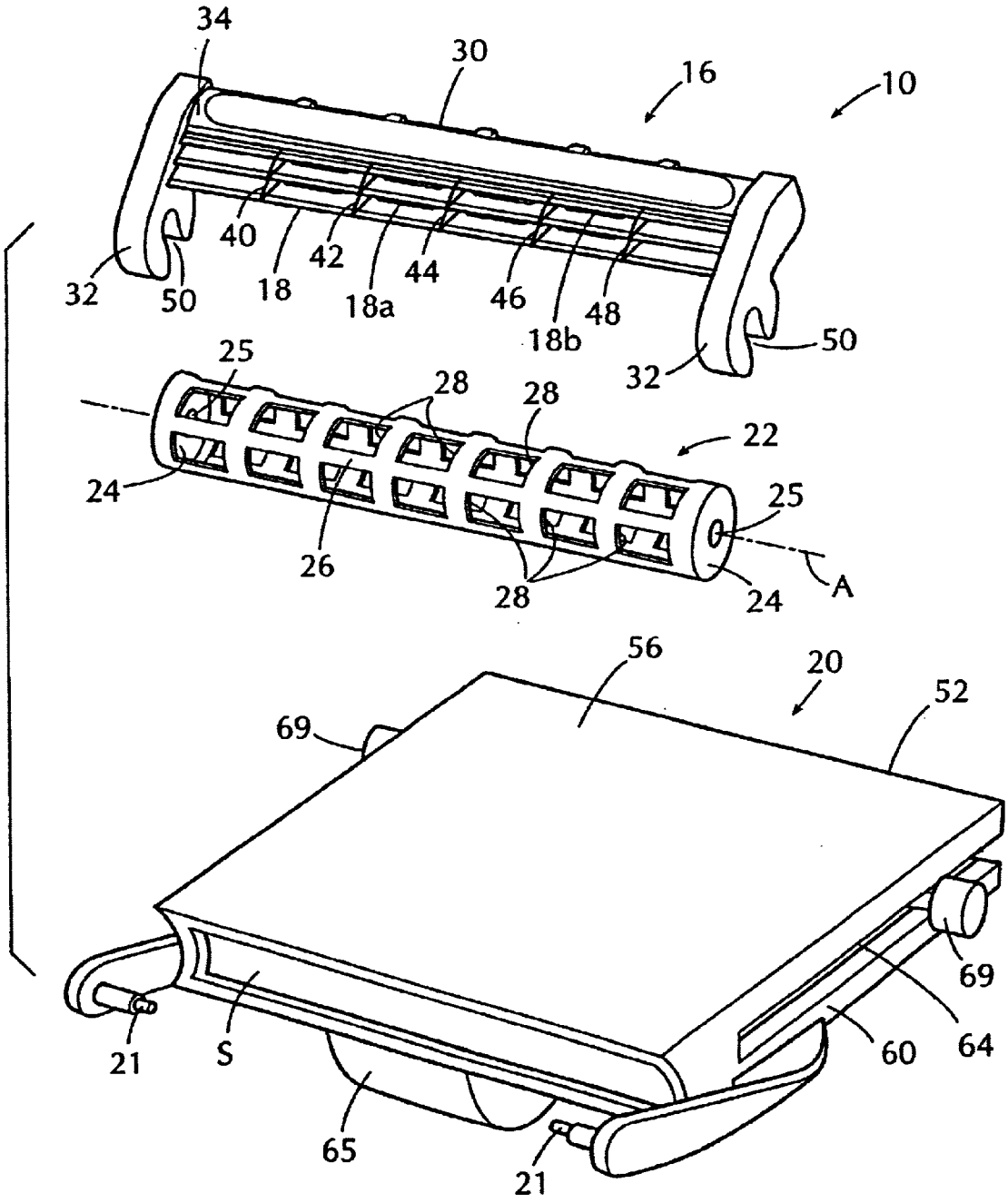
FIG. 5 is an exploded orthographic view of the wet shaving device shown in FIG. 1.

Considering now the razor 10 in further detail and as oriented in the drawings, the disposable blade cartridge 16 and the guard/transfer roller 22 which forms a guard for the lead blade 18 carried by the blade cartridge are supported on a common axis designated by the letter A in FIG. 1 and defined by a pair of axially spaced apart coaxial axel shaft 21, 21 mounted in fixed position on and at opposite sides of the shaving aid dispenser 20 as best shown in FIG. 5 and as hereinafter more fully described. The guard/dispenser roller may be made from a variety of materials and may take various forms, however, the illustrated roller 22 preferably comprises a hollow generally cylindrical tubular member formed from stainless steel and includes radially disposed opposite end walls 24, 24 which have coaxial cylindrical aperture 25,25 for receiving the axles 21, 21. The tubular roller 22 has a generally cylindrical roller surface 26 and a plurality of apertures formed therein which define openings 28,28 through the surface 26. The number, size, shape and arrangement of the openings 28, 28 may vary, however the illustrated openings are generally rectangular and arranged in a regular pattern of in-line rows generally parallel to the axis A. The free end portions of the axles 21, 21 upon which the roller 22 is journalled are of somewhat reduced diameter to generally complement the apertures 25, 25 so that the roller may rotate freely on the axles while being restrained against movement in an axial direction thereon.

Figure 2:
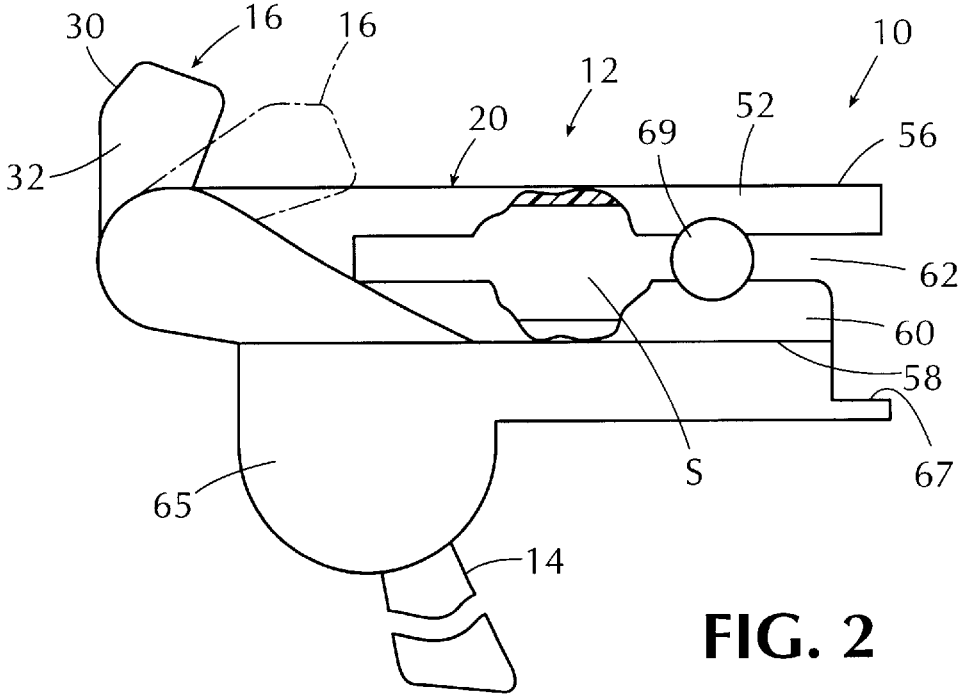
FIG. 2 is a somewhat enlarged fragmentary side elevational view of the wet shaving device shown in FIG. 1.

The disposable blade cartridge 16, best shown in FIG. 2, has a frame 30, preferably molded from a durable lightweight resilient plastic material and includes a pair of spaced apart sidewalls 32, 32 integrally joined by a connecting wall 34 which extends therebetween. The illustrated blade cartridge 16 carries three blades which include the seat blade 18 and two additional flat blades substantially identical to the seat blade and indicated at 18*a* and 18*b*. The illustrated three flat blades 18, 18*a* and 18*b* have parallel rectilinear cutting edges and are arranged with the flat surfaces thereof in parallel spaced apart relation to each other. The three blades are supported by and extend between the sidewalls 32, 32, substantially as shown. The blade cartridge preferably also includes one or more skin guard rails, such rails being shown in the drawings and indicated at 40–48.

A radially outwardly open keyhole slot 50 is formed in each side wall 32, as shown in FIG. 5. The blade cartridge is adapted for releasable attachment to the axles 21, 21 in straddling relation to the guard/dispenser roller 22, the spacing between the opposing inner surfaces of the sidewalls 32, 32 being substantially equal to the axial length of the roller 22. Leading portions of the sidewalls 32, 32 have parti-cylindrical configurations to substantially compliment the cylindrical configuration of the roller surface 26. The substantially flat seat blade 18 is disposed in a plane generally tangential to the roller surface 26 and with its cutting edge substantially uniformly spaced from the roller surface 26 along its entire length. The keyhole slots 50, 50 are adapted for snap engagement with associated portions of the axles 21, 21 and serve to releasable retain the disposable cartridge 16 in its assembled position relative to the guard/transfer roller 22. The roller 22 is supported to rotate freely about the axis A relative to the razor handle 14, the shaving aid dispenser 20 and the blade cartridge 16 whereas the blade cartridge is supported on the axles 21, 21 for limited reciprocal pivotal or rocking movement from a normal or at rest position through a range of tracking positions relative to the razor handle to track the skin surface being shaved as the razor moves over the skin surface with a normal shaving movement. In FIG. 2 the at rest position of the disposable blade cartridge 16 is shown in full lines, the approximate maximum limit of the tracking position being indicated by broken lines. A blade cartridge biasing means of a well known type (not shown) is provided for biasing the blade cartridge in counterclockwise direction toward and to its at rest position of FIG. 2 and may, for example, comprise a spring biased plunger or a leaf spring acting between the shaving aid dispenser 20 and the blade cartridge 16 to normally urge the blade cartridge to its at rest position.

Figure 4:
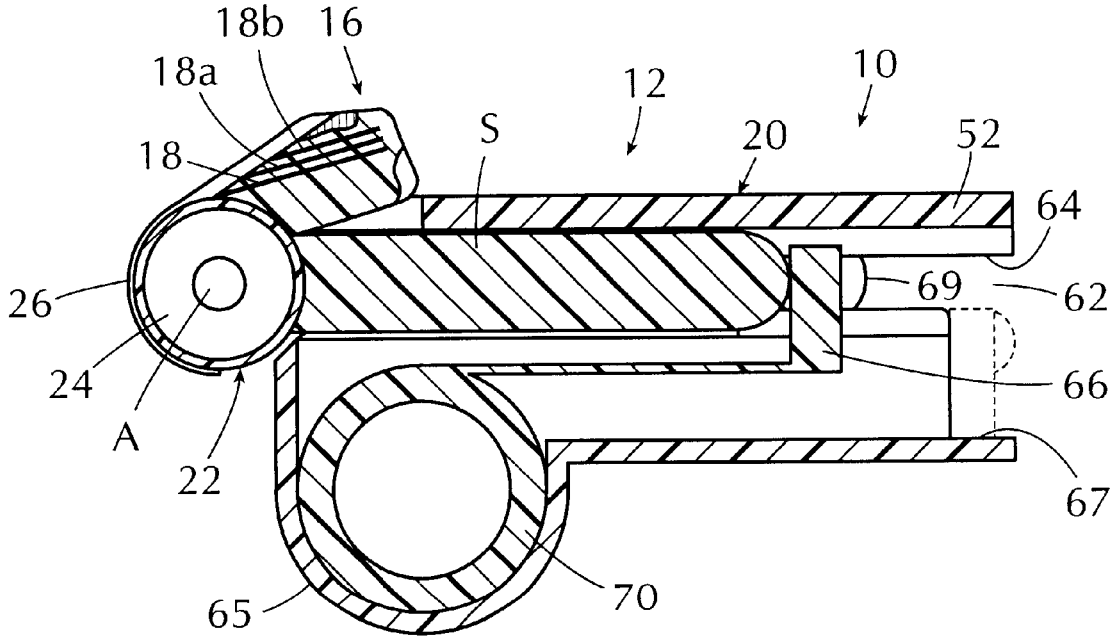
FIG. 4 is a somewhat schematic fragmentary sectional view taken along the line 4—4 of FIG. 3.

The presently preferred shaving aid dispenser 20 formed by the razor head 12 comprises a generally rectangular dispenser housing 52 carried by the handle 14 and has a top wall 56, a pair of laterally spaced apart bottom walls 58, 58, and a pair of opposing sidewalls 60, 60, which provide connection between forward end portions of the top wall 56 and the bottom walls 58, 58. The top, bottom, and sidewalls cooperate to define a forwardly and rearwardly open dispensing slot 62 of generally rectangular cross section for receiving and containing a generally rectangular solid block of water-soluble shaving aid material, or medicated soap preparation S, such as shown in FIG. 4. A pair of guide slots 64, 64 formed in the sidewalls 60, 60 communicate with the dispensing slot 62, extend longitudinally of the sidewalls and open outwardly through the rear ends thereof.

The housing 52 further includes and upwardly and rearwardly open spring receptacle or well 65 which depends from the bottom walls 58, 58 and extends centrally along the lower side of the housing 52 from front to rear, for a purpose which will be hereinafter evident. The spring receptacle opens upwardly into the dispensing slot 62 and outwardly through the rear of the housing 52. The forward portion of the spring well 65 is particularly adapted to receive a coil spring 70 whereas the rear portion of the well defines an upwardly open rectilinear channel for receiving a tail portion of a coil spring. The lowermost wall of the housing 52 extends for some distance rearwardly and beyond the rear ends of the sidewalls 60, 60 and forms a step or shelf 67 at the rear of the dispenser housing 52 below the level of the guide slots 64, 64.

The illustrated shaving aid dispenser housing 52, which is carried by the razor handle 14, may be integrally connected to the handle or releasably connected to it and is disposed with its top and bottom walls 56 and 58, 58, respectively, parallel to and equidistantly spaced from an axial plane of the axis A so that the guard/dispenser roller 22 provides a substantial closure for the forward end of the dispensing slot 62, which slot is bisected by the aforesaid axial plane. Preferably, and as shown, the vertical width of the dispensing slot 62 is somewhat less than the diameter of the roller surface 26. A laterally extending pusher 66 is disposed within the dispensing slot 62, extends transversely of the latter slot, and has reduced opposite end portions 68, 68 of generally rectangular cross section which complement associated portions of the guide slots and project laterally outwardly from the guide slots 64, 64 at opposite sides of the housing 52. The pusher end portions 68, 68 cooperate with the guide slots 64, 64 to maintain the pusher 66 with the frontal face of the pusher in a vertically oriented forwardly facing position, that is facing in the direction of the roller 22. Enlarged heads or finger grips 69, 69 are formed on the outer ends of the reduced portions 68, 68 for a reason which will be hereinafter explained. A coiled constant pressure spring 70 received within the spring well 65 has a coiled inner end (not shown) secured in fixed position relative to the dispenser housing 52. A rearwardly projecting end portion or tail of the coil spring 70 is connected to the pusher 66, as best shown in FIG. 4. The constant pressure spring 70 continuously urges the pusher in a forward direction within the dispensing slot 62 and toward the guard/transfer roller 22.

The pusher 66 cooperates with the constant pressure spring 70 to provide a closure for the rear end of the dispensing slot 62 and thereby serves to both releasably retain a block of water-soluble shaving aid preparation S in the dispensing slot 62 and bias the shaving aid preparation S toward and into engagement with the guard/dispenser roller 22.

Figure 3:
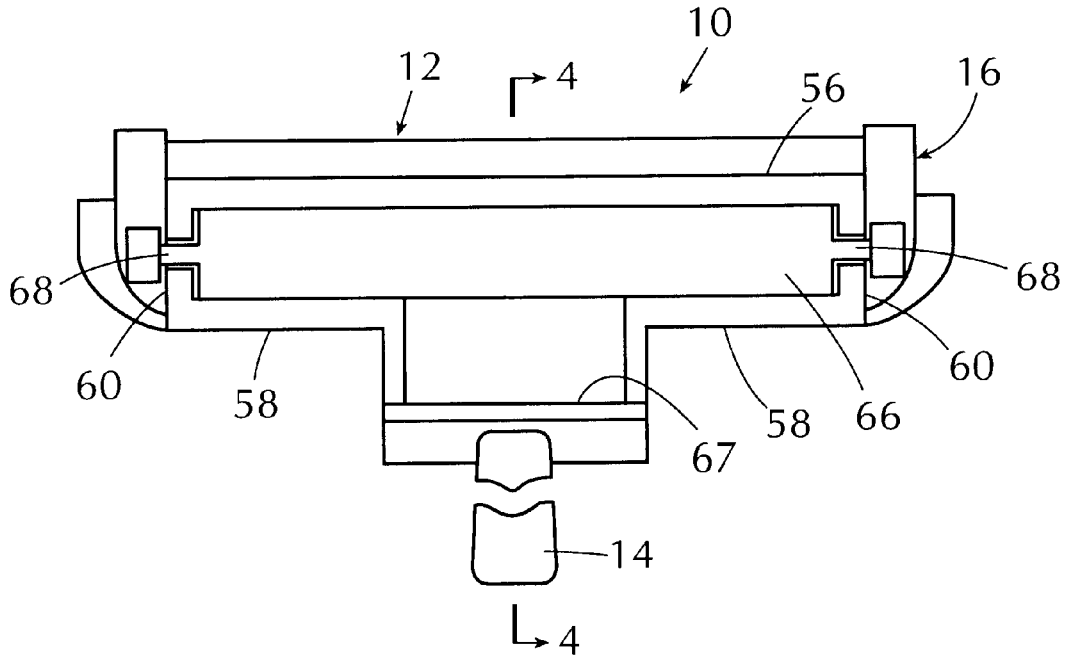
FIG. 3 is a somewhat enlarged fragmentary rear elevational view of the device of FIG. 1.

As the wetted razor head 10 is advanced along the skin surface with a conventional shaving motion the guard/dispenser roller 22, disposed in frictional engagement with the skin, rotates in a clockwise direction from its position of FIG. 3, picks up a film of shaving aid material, which forms over the openings 28, 28 and on the roller surface 26, and transfers the film of shaving aid preparation to and deposits it on the skin surface ahead of the advancing lead or seat blade 18.

When the block of shaving aid preparation S is partially spent and the forwardly facing surface of the pusher 66 attains a position generally above the central axis of the coiled constant pressure spring 70 whereupon the spring ceases to be effective as a biasing means. The spent shaving aid preparation S within the razor head should now be replenished.

While the razor handle is held in one hand, the finger grips 69, 69 on the outer ends of the pusher 66 are grasped between the thumb and forefinger of the other hand and the pusher 66 is drawn to the rear and out of the dispensing slot 62 and the guide slots 64, 64, whereupon the pusher 66 may be moved downwardly to a seating position on the shelf 67, the latter position of the pusher 66 being shown in broken lines in FIG. 4. The rear end of the dispensing slot 62 is now open to receive a new block of shaving aid preparation material S. The dispensing slot 62 is of sufficient length to accommodate the partially consumed block S already in the slot, a new or unused block of shaving aid preparation (not shown) which has been inserted into the slot 62, and the pusher 66 which is raised from its seated position and returned to its operative position at the rear of the dispensing slot 62, in pushing position behind the new block. The new or replenished block of shaving aid preparation now serves as a pusher to urge the partially consumed block toward and into engagement with the guard/transfer roller 22. The new block of shaving aid preparation cannot make contact with the roller surface 26 until the partially spend block has been totally consumed in the shaving process. Consequently, the razor 10 enables the most efficient possible utilization of shaving aid preparation while avoiding direct contact between the solid block of shaving aid preparation and the skin surface.

Figure 6:
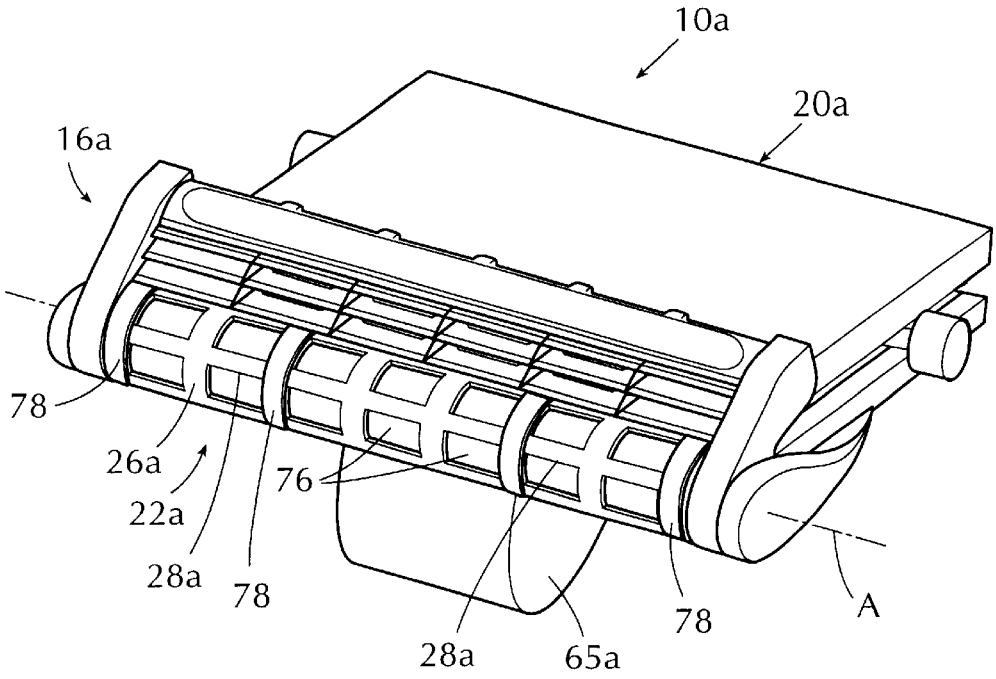
FIG. 6 is similar to FIG. 1, but shows another wet shaving device embodying the present invention.

Referring now to FIG. 6, another wet shaving device or razor embodying the present invention is indicated generally by the reference number 10*a*. The illustrated razor 10*a* is substantially identical in most respects to the razor 10 previously described and parts of the razor 10*a* which correspond to parts of the previously described razor 10 bear the same reference numeral and the letter "a" suffix and with not be hereinafter further described.

The razor 10*a* differs from the razor 10 in the construction and arrangement of the guard/transfer roller indicated at 22*a*. Unlike the roller 22, the roller 22*a* comprises a solid member which may be formed from any suitable material, a plastic or ceramic material being presently preferred. The roller 22*a* has a generally cylindrical roller surface 26*a*. A plurality of shallow recesses 76, 76 formed in the roller 22*a* and opening outwardly through the surface 26*a* define a plurality of openings in the roller surface indicated at 28*a*, 28*a*. The roller 22*a* further differs from the previously described roller in that it includes a plurality of annular bands of friction material 78, 78 which coaxially surround the roller at axially spaced apart locations along the roller surface. The bands 78, 78 are preferably made from a material different from the material from which the roller 22*a* is made to provide increased frictional engagement with the skin and improved traction as the roller moves along the surface of the skin during the normal shaving operation.

Figure 7:
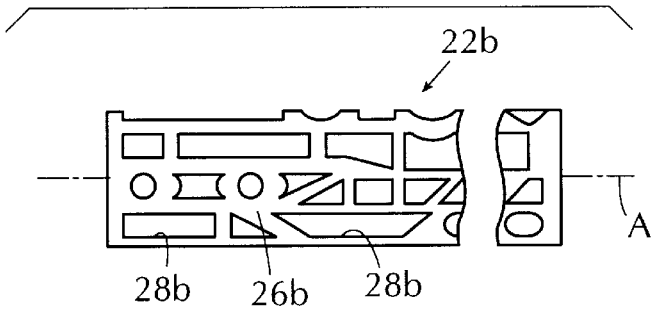
FIG. 7 is a side elevational view of another guard/transfer roller.

A further form of a guard/dispenser roller is shown in FIG. 7 and indicated at 22*b*. The illustrated roller 22*b* comprises a solid roller having a roller surface 26*b* and a plurality of shallow recesses which define surface openings 28*b*, 28*b* dispersed over the surface of the roller in a random pattern.

Figure 8:
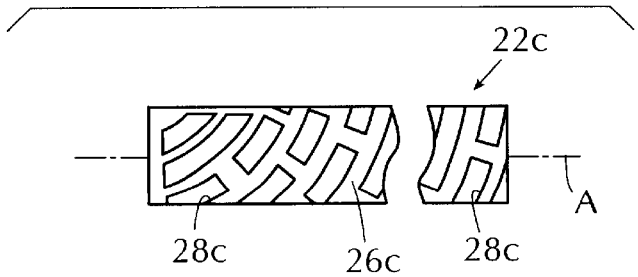
FIG. 8 is a side elevational view of still another guard/transfer roller for use in practicing the invention.

Still another form of roller is shown in FIG. 8 where the roller is indicated at 22*c*. Unlike the previously described rollers, the solid roller 22*c* has openings 28*c*, 28*c* in the surface 26*c* thereof arranged in a helical pattern on the surface of the roller and about the roller axis A. The in-line helical rows of openings 28*c*, 28*c* are helically offset relative each other so that soap film which forms over the openings as the roller rotate in contact with a block of shaving aid preparation will be transferred to and deposited upon the skin surface in overlapping relation to each other to assure complete skin coverage in the region being shaved.

I claim:

1. A wet shaving device comprising; a razor head, at least one blade carried by said razor head, mounting means for supporting a block of water-soluble shaving preparation said block of water-soluble shaving preparation movable relative to said razor head, a guard/transfer roller having a generally cylindrical roller surface and supported on said razor head in leading relation to said one blade for rotation about an axis fixed relative to said mounting means, retaining means for releasably securing to said razor head said block of water-soluble shaving preparation supported by said mounting means, and biasing mean for urging said block of water-soluble shaving preparation supported by said mounting means toward and into engagement with said roller surface.

2. A wet shaving device as set forth in claim 1 wherein said roller surface has a plurality of openings therein.

3. A wet shaving device as set forth in claim 2 wherein said roller is further characterized as a hollow roller having a tubular wall defining said roller surface and said openings as defined by apertures through said tubular wall communicating with the interior of said roller.

4. A wet shaving device as set forth in claim 2 wherein said roller is further characterized as a solid roller and said opening are defined by recesses in said roller.

5. A wet shaving device as set forth in claim 2 wherein said openings form a regular pattern on said roller surface.

6. A wet shaving device as set forth in claim 5 wherein said pattern comprises a helical pattern.

7. A wet shaving device as set forth in claim 2 wherein said openings form an irregular pattern on said roller surface.

8. A wet shaving device as set forth in claim 1 wherein said mounting means comprises a dispensing slot formed in said razor head for receiving and containing said block of water-soluble shaving preparation therein and said guard/transfer roller forms a closure for said slot.

9. A wet shaving device as set forth in claim 8 wherein said slot has slot openings at its opposite ends and said roller forms a closure for one of said slot openings and said retaining means forms a closure for another of said slot openings.

10. A wet shaving device as set forth in claim 9 wherein said retaining means comprises a pusher received within said dispensing slot.

11. A wet shaving device as set forth in claim 10 wherein said biasing means comprising a constant pressure spring acting between said razor head and said pusher.

12. A wet shaving device as set forth in claim 10 wherein said retaining means comprises said biasing means.

13. A wet shaving device as set forth in claim 12 wherein said biasing means comprises means for urging said pusher in the direction of said guard/transfer roller.

14. A wet shaving device as set forth in claim 1 wherein said retaining means comprises said biasing means.

15. A wet shaving device as set forth in claim 1 wherein said at least one blade is carried by a disposable blade cartridge releasably secured to said razor head.

16. A wet shaving device as set forth in claim 15 wherein said disposable blade cartridge is supported for limited angular movement about said axis.

17. A wet shaving device as set forth in claim 1 wherein said guard/transfer roller has a plurality of axially spaced apart coaxial annular bands on said roller surface, each of said bands having a diameter greater than the diameter of said roller surface.

18. A wet shaving device as set forth in claim 17 wherein said guard/transfer roller is made from one material and said bands are made from another material.

19. A wet shaving device comprising; a razor head, at least one blade mounted on said razor head and having an elongated rectilinear cutting edge, a guard/dispenser roller having a generally cylindrical roller surface and supported on said razor head in advance of said one blade for rotation about an axis parallel to said cutting edge, said roller surface extending along substantially the entire length of said cutting edge in uniformally spaced relation to said cutting edge, mounting means for supporting a solid block of replaceable water-soluble shaving aid preparation on said razor head said block of shaving-aid preparation movable to a dispensing position wherein said shaving aid preparation engages said roller surface along substantially the entire axial length of said roller surface, retaining means for releasably securing said shaving aid preparation on said razor head, and biasing means for urging said shaving aid preparation toward and to said dispensing position.

20. A wet shaving device comprising; a razor head including a shaving aid dispenser defining a dispensing slot for receiving and containing a solid water-soluble shaving aid and having end openings at opposite ends thereof, a guard/transfer roller having a generally cylindrical roller surface and a surface opening in said roller surface, said guard/transfer roller supported on said razor head for rotation about an axis fixed relative to said shaving aid, said guard/transfer roller forming a substantial closure for one of said end openings, a disposable blade cartridge having a plurality of blades mounted in fixed position thereon, each of said blades having a rectilinear cutting edge, mounting means for releasably securing said disposable blade cartridge to said shaving device for limited angular movement about said axis and relative to said shaving aid dispenser with said guard/transfer roller in leading relation to said blades and said rectilinear cutting edges in parallel alignment with said axis, and retaining and biasing means for releasably securing said solid water-soluble shaving aid in said shaving aid dispenser while continuously urging the shaving aid toward and into engagement with said roller surface and including an elongated pusher disposed within said dispensing slot and bearing against the shaving aid, said pusher having finger grips at opposite ends thereof exposed externally of said shaving aid dispenser, and a constant pressure spring carried by said shaving aid dispenser and acting between said shaving aid dispenser and said pusher to retain said pusher within said dispensing slot and urge said pusher in the direction of said guard/transfer roller.

* * * * *